US010789917B2

(12) United States Patent
Kato et al.

(10) Patent No.: US 10,789,917 B2
(45) Date of Patent: Sep. 29, 2020

(54) SOUND PROCESSING DEVICE AND SOUND PROCESSING METHOD

(71) Applicant: Yamaha Corporation, Hamamatsu-shi (JP)

(72) Inventors: Masakazu Kato, Hamamatsu (JP); Takashi Sakamoto, Hamamatsu (JP); Hideaki Takehisa, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/288,564

(22) Filed: Feb. 28, 2019

(65) Prior Publication Data

US 2019/0279604 A1 Sep. 12, 2019

(30) Foreign Application Priority Data

Mar. 7, 2018 (JP) ..... 2018-041305

(51) Int. Cl.
*G10D 13/06* (2020.01)
*G10H 1/02* (2006.01)
*G10H 3/14* (2006.01)

(52) U.S. Cl.
CPC ..... *G10D 13/06* (2013.01); *G10H 1/02* (2013.01); *G10H 3/146* (2013.01)

(58) Field of Classification Search
CPC ..... G10D 13/06; G10H 1/02
See application file for complete search history.

(56) References Cited

U.S. PATENT DOCUMENTS 5,223,657 A * 6/1993 Takeuchi ..... G10H 5/007 381/63
5,633,473 A * 5/1997 Mori ..... G10H 3/146 84/625
5,633,474 A * 5/1997 Cardey, III ..... G10H 1/0058 84/663
6,271,458 B1 * 8/2001 Yoshino ..... G10H 3/146 84/414
6,753,467 B2 * 6/2004 Tanaka ..... G10H 3/146 84/104

(Continued)

FOREIGN PATENT DOCUMENTS

JP 3262625 B2 3/2002
JP 2016080917 A 5/2016

(Continued)

OTHER PUBLICATIONS

Office Action issued in Japanese Appln No. 2018-041305 dated Sep. 24, 2019. English translation provided.

(Continued)

*Primary Examiner* — Robert W Horn
(74) *Attorney, Agent, or Firm* — Rossi, Kimms & McDowell LLP

(57) ABSTRACT

A sound processing device includes: a combining processor that combines a performance sound and a source sound, based on operation information corresponding to a performance operation on an instrument. The performance sound is obtained by picking up a sound generated by the performance operation on the instrument. The source sound is obtained from a sound source.

19 Claims, 8 Drawing Sheets

(56) References Cited

U.S. PATENT DOCUMENTS

| | | | | |
|---|---|---|---|---|
| 7,381,885 | B2 * | 6/2008 | Arimoto | G10H 1/0008 84/723 |
| 7,385,135 | B2 * | 6/2008 | Yoshino | G10D 13/024 84/414 |
| 7,473,840 | B2 * | 1/2009 | Arimoto | G10H 1/06 84/615 |
| 7,935,881 | B2 * | 5/2011 | Aimi | G10H 3/146 84/104 |
| 9,093,057 | B2 * | 7/2015 | Mejia | G10H 1/02 |
| 9,263,020 | B2 * | 2/2016 | Takasaki | G10H 3/146 |
| 9,589,552 | B1 * | 3/2017 | Nishi | G10H 3/12 |
| 10,056,061 | B1 * | 8/2018 | Graham | G10H 3/186 |
| 2019/0221199 | A1 * | 7/2019 | Nomura | G10H 3/143 |
| 2019/0279604 | A1 * | 9/2019 | Kato | G10D 13/06 |
| 2019/0304423 | A1 * | 10/2019 | Ohta | G10H 1/02 |

FOREIGN PATENT DOCUMENTS

| | | | |
|---|---|---|---|
| JP | 2017102303 | A | 6/2017 |
| JP | 2019124833 | A | 7/2019 |

OTHER PUBLICATIONS

Office Action issued in Chinese Appln. No. 201910132962.5 dated Mar. 3, 2020. English translation provided.

* cited by examiner

SOUND PROCESSING DEVICE AND SOUND PROCESSING METHOD

CROSS-REFERENCE TO RELATED APPLICATION

Priority is claimed on Japanese Patent Application No. 2018-041305, filed Mar. 7, 2018, the content of which is incorporated herein by reference.

BACKGROUND OF THE INVENTION

Field of the Invention

The present invention relates to a sound processing device and a sound processing method.

Description of Related Art

Percussion instruments such as silent acoustic drums and electronic drums that mute the impact sound are increasingly being used in recent years. There is also known a technique of using for example a resonance circuit in such a percussion instrument to alter the impact sound in accordance with the manner in which a strike is applied (see, for example, Japanese Patent No. 3262625).

However, the related technique described above may for example produce an unnatural impact sound, leading to difficulties in reproducing the expressive power of an ordinary acoustic drum.

SUMMARY OF THE INVENTION

The present invention has been achieved to solve the aforementioned problems. An object of the present invention is to provide a sound processing device and a sound processing method that can improve the expressive power of a performance sound by a musical instrument.

A sound processing device according to one aspect of the present invention includes: a combining processor that combines a performance sound and a source sound, based on operation information corresponding to a performance operation on an instrument. The performance sound is obtained by picking up a sound generated by the performance operation on the instrument. The source sound is obtained from a sound source.

A sound processing method according to one aspect of the present invention includes: combining a performance sound and a source sound, based on operation information corresponding to a performance operation on an instrument. The performance sound is obtained by picking up a sound generated by the performance operation on the instrument. The source sound is obtained from a sound source.

According to an embodiment of the present invention, it is possible to improve the expressive power of a performance sound from an instrument.

DETAILED DESCRIPTION OF THE INVENTION

Hereinbelow, sound processing devices according to embodiments of the present invention will be described with reference to the drawings.

First Embodiment

Figure 1:
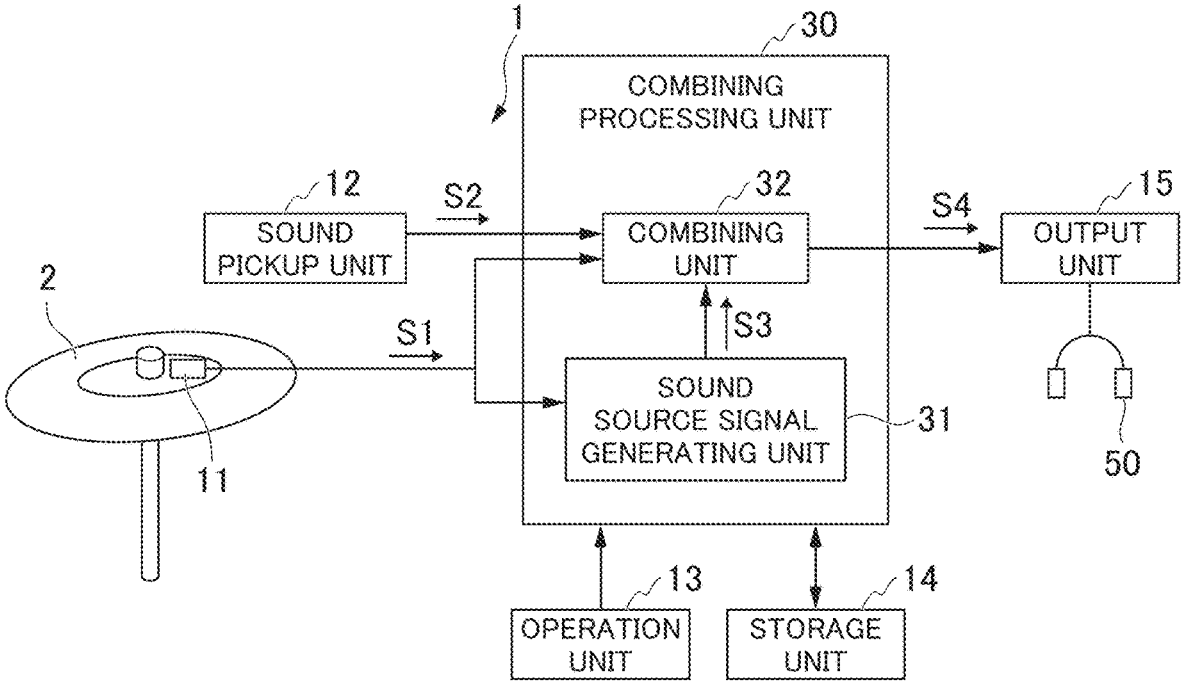
FIG. 1 is a block diagram that shows an example of a sound processing device according to a first embodiment.

FIG. 1 is a block diagram that shows an example of a sound processing device 1 according to a first embodiment.

As shown in FIG. 1, the sound processing device 1 includes a sensor unit 11, a sound pickup unit 12, an operation unit 13, a storage unit 14, an output unit 15, and a combining processing unit 30. The combining processing unit 30 is an example of a processor such as a central processing unit (CPU). The sound processing device 1 performs an acoustic process of combining, for example, a sound from a pulse code modulation (PCM) sound source (hereinbelow called a PCM sound source sound) with an impact sound of a percussion instrument (an example of an instrument) such as a drum. The PCM sound source is one example of a sound source. A sound from the PCM sound source is one example of a source sound. In the present embodiment, as an example of a percussion instrument, an example is described of acoustically processing an impact sound of a cymbal 2 of a drum set.

The cymbal 2 is, for example, a ride cymbal or a crash cymbal of a drum set having a silencing function.

The sensor unit 11 is installed on the cymbal 2 and detects the presence of a strike by which the cymbal 2 is played as well as time information of the strike (for example, the timing of the strike). The sensor unit 11 includes a vibration sensor such as a piezoelectric sensor. For example, when the detected vibration exceeds a predetermined threshold value, the sensor unit 11 outputs a pulse signal as a detection signal S1 to the combining processing unit 30 for a predetermined period. Alternatively, regardless of whether or not the detected vibration exceeds a predetermined threshold value, the sensor unit 11 may output, as the detection signal S1, a signal indicating the detected vibration to the combining processing unit 30. In this case, the combining processing unit 30 may determine whether or not the detection signal S1 exceeds the predetermined threshold value.

The sound pickup unit 12 is, for example, a microphone, and picks up an impact sound of the cymbal 2 (performance sound of a musical instrument). An impact sound of the cymbal 2 is an example of a sound generated by a performance operation on an instrument. The instrument is, for example, a musical instrument such as the cymbal 2. The sound pickup unit 12 outputs an impact sound signal S2 indicating a sound signal of the picked up impact sound to the combining processing unit 30.

The operation unit 13 is, for example, a switch or an operation knob for accepting various operations of the sound processing device 1.

The storage unit 14 stores information used for various processes of the sound processing device 1. The storage unit 14 stores, for example, sound data of a PCM sound source (hereinafter referred to as PCM sound source data), settings information of sound processing, and the like.

The output unit 15 is an output terminal connected to an external device 50 via a cable or the like, and outputs a sound signal (combined signal S4) supplied from the combining processing unit 30 to the external device 50 via a cable or the like. The external device 50 may be, for example, a sound emitting device such as headphones.

On the basis of the timing (time information) of the strike detected by the sensor unit 11, the combining processing unit 30 combines the impact sound picked up by the sound pickup unit 12 and the PCM sound source sound. Here, the timing of the strike is an example of operation information relating to a performance operation obtained depending on the presence of a performance operation (strike). That is, the timing of the strike is an example of operation information relating to a performance operation obtained by generation of a performance operation (strike).

For example, the PCM sound source sound is generated in advance so as to supplement a component lacking in the impact sound of the cymbal 2 with respect to a target impact sound. The lacking component is, for example, a frequency component, a time change component (a component of transient change), or the like. Here, the target impact sound is a sound indicating an impact sound that is targeted (for example, the impact sound of a cymbal in an ordinary drum set). The target impact sound is an example of the target performance sound indicating the performance sound that is targeted.

In the case of the impact sound of the cymbal 2, the combining processing unit 30 combines an attack portion obtained from the impact sound picked up by the sound pickup unit 12 and a body portion obtained from the PCM sound source sound. Here, with reference to FIG. 2, the waveform of an impact sound of an ordinary acoustic drum (for example, a cymbal) will be described.

Figure 2:
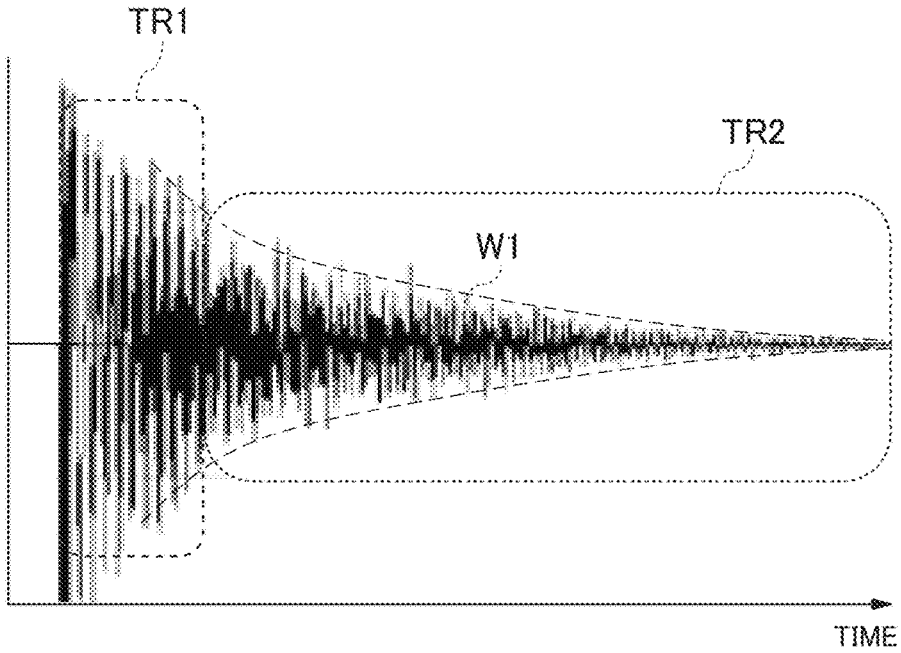
FIG. 2 is a diagram for describing an example of a waveform of an impact sound signal in an ordinary drum.

FIG. 2 is a diagram for describing an example of a waveform of an impact sound signal in an ordinary drum.

In this figure, the horizontal axis represents time and the vertical axis represents signal level (voltage). A waveform W1 shows the waveform of the impact sound signal.

The waveform W1 includes an attack portion (first period) TR1 indicating a predetermined period immediately after a strike and a body portion (second period) TR2 indicating a period after the attack portion. In the case of a ride cymbal, the attack portion TR1 is a period ranging from several tens of milliseconds to several hundred milliseconds immediately after a strike (that is, after the start of a strike). In the case of a crash cymbal, the attack portion TR1 is about 1 second to 2 seconds from the start of a strike. Also, in the attack portion TR1, various frequency components coexist due to the strike. "Immediately after a strike" means a timing at which the impact sound picked up by the sound pickup unit 12 such as a microphone becomes equal to or greater than a predetermined value. "Immediately after the strike" is almost the same as a timing at which the detection signal S1 becomes an H (high) state (described later).

In addition, here, the waveform W1 shown in FIG. 2 is, for example, the signal waveform of a target impact sound indicating an impact sound that is targeted.

The body portion TR2 is a period in which the signal level attenuates with a predetermined attenuation factor (predetermined envelope).

In percussion instruments or electronic percussion instruments such as the cymbal 2 having a silencing function, for example, the signal level of the sound signal of the body portion TR2 tends to be smaller compared to the impact sound of an ordinary cymbal.

For that reason, in the present embodiment, the combining processing unit 30 performs sound combination using the impact sound picked up by the sound pickup unit 12 for the attack portion TR1 and using the PCM sound source sound for the body portion TR2.

Returning to the description of FIG. 1, the combining processing unit 30 is a signal processing unit including, for example, a CPU (central processing unit), a DSP (digital signal processor), and the like. The combining processing unit 30 also includes a sound source signal generating unit 31 and a combining unit 32.

The sound source signal generating unit 31 generates, for example, a sound signal of a PCM sound source and outputs the sound signal to the combining unit 32 as a PCM sound source sound signal S3. The combining processing unit 30 reads sound data from the storage unit 14, with the detection signal S1 serving as a trigger. Here, the sound data is stored in advance in the storage unit 14. The detection signal S1 indicates the timing of the strike detected by the sensor unit 11. The sound source signal generating unit 31 generates the PCM sound source sound signal S3 based on the sound data that has been read out. The sound source signal generating unit 31 generates, for example, the PCM sound source sound signal S3 of the body portion TR2.

The combining unit 32 combines the impact sound signal S2 picked up by the sound pickup unit 12 and the PCM sound source sound signal S3 generated by the sound source signal generating unit 31 to generate a combined signal (combined sound) S4. For example, the combining unit 32 combines the impact sound signal S2 of the attack portion TR1 and the PCM sound source sound signal S3 of the body portion TR2 in synchronization with the detection signal S1 of the timing of the strike detected by the sensor unit 11. Here, the combining unit 32 may combine the impact sound signal S2 and the PCM sound source sound signal S3 simply by addition of these signals. The combining unit 32 may perform combination of the signals S2 and S3 by switching between the impact sound signal S2 and the PCM sound source sound signal S3 at the boundary between the attack portion TR1 and the body portion TR2.

The combining unit 32 may detect (determine) the boundary between the attack portion TR1 and the body portion TR2 as a position (corresponding to the point in time) after a predetermined period of time has elapsed from the detection signal S1 of the timing of the strike. The combining unit 32 may determine the boundary on the basis of a change in the frequency component of the impact sound signal S2. For example, the combining unit 32 may include a low-pass filter, and determine, as the boundary between the attack portion TR1 and the body portion TR2, the point in time at which the value of the pitch of the impact sound signal S2 which has passed through the low-pass filter is stable (the frequency components of the impact sound signal S2 which are more than a predetermined value are eliminated by the low-pass filter). Alternatively, the combining unit 32 may determine the boundary between the attack portion TR1 and the body portion TR2 by an elapsed period from the strike timing set by the operation unit 13.

The combining unit 32 outputs the combined signal S4 that has been generated to the output unit 15.

Next, the operation of the sound processing device 1 according to the present embodiment will be described with reference to FIGS. 3 and 4.

Figure 3:
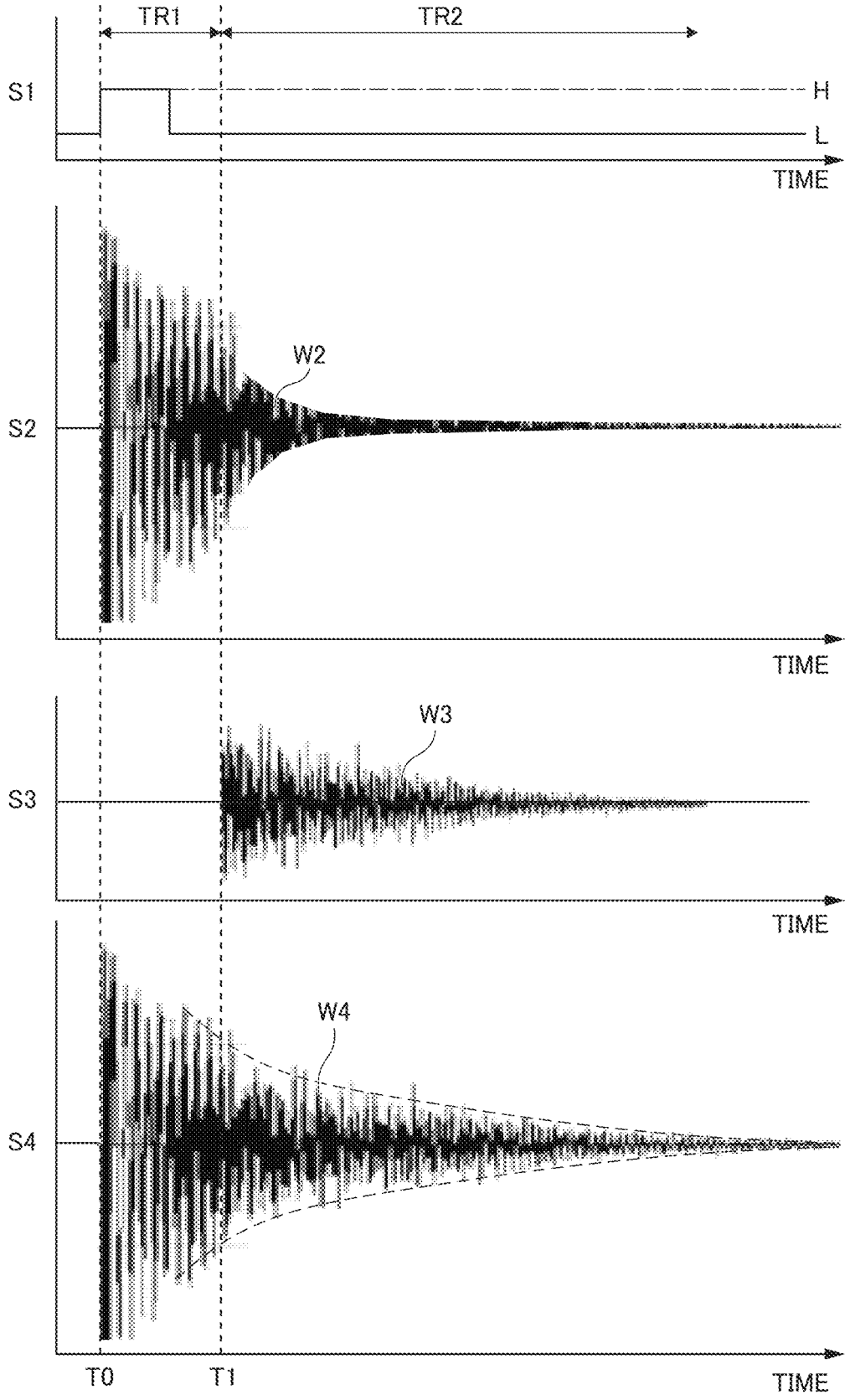
FIG. 3 showing an example of the operation of the sound processing device according to the first embodiment.

FIG. 3 is a diagram showing an example of the operation of the sound processing device 1 according to the present embodiment.

The signal shown in FIG. 3 includes, in order from the top, the detection signal S1 of the sensor unit 11, the impact sound signal S2 picked up by the sound pickup unit 12, the PCM sound source sound signal S3 generated by the sound source signal generating unit 31, and the combined signal S4 generated by the combining unit 32. The horizontal axis of each signal shows time, while the vertical axis shows the logic state for the detection signal S1 and the signal level (voltage) for the other signals.

As shown in FIG. 3, when the user plays the cymbal 2 at time T0, the sensor unit 11 puts the detection signal S1 into the H (high) state. In addition, the sound pickup unit 12 picks up the impact sound of the cymbal 2 and outputs the impact sound signal S2 as shown in a waveform W2.

In addition, the sound source signal generating unit 31 generates the PCM sound source sound signal S3 on the basis of the PCM sound source data stored in the storage unit 14, with the transition of the detection signal S1 to the H state serving as a trigger. The PCM sound source sound signal S3 includes the body portion TR2 as shown in a waveform W3.

In addition, the combining unit 32 combines the impact sound signal S2 of the attack portion TR1 and the PCM sound source sound signal S3 of the body portion TR2, to generate the combined signal S4 as shown in a waveform W4, with the transition of the detection signal S1 to the H state serving as a trigger. Note that in combining the waveform W2 and the waveform W3, the combining unit 32 determines, for example, a predetermined period directly after the strike (the period from time T0 to time T1) as the attack portion TR1 and determines a period from time T1 onward as the body portion TR2.

The combining unit 32 outputs the combined signal S4 of the generated waveform W4 to the output unit 15. Then, the output unit 15 causes the external device 50 (for example, a sound emitting device such as headphones) to emit the combined signal of the waveform W4 via a cable or the like.

Figure 4:
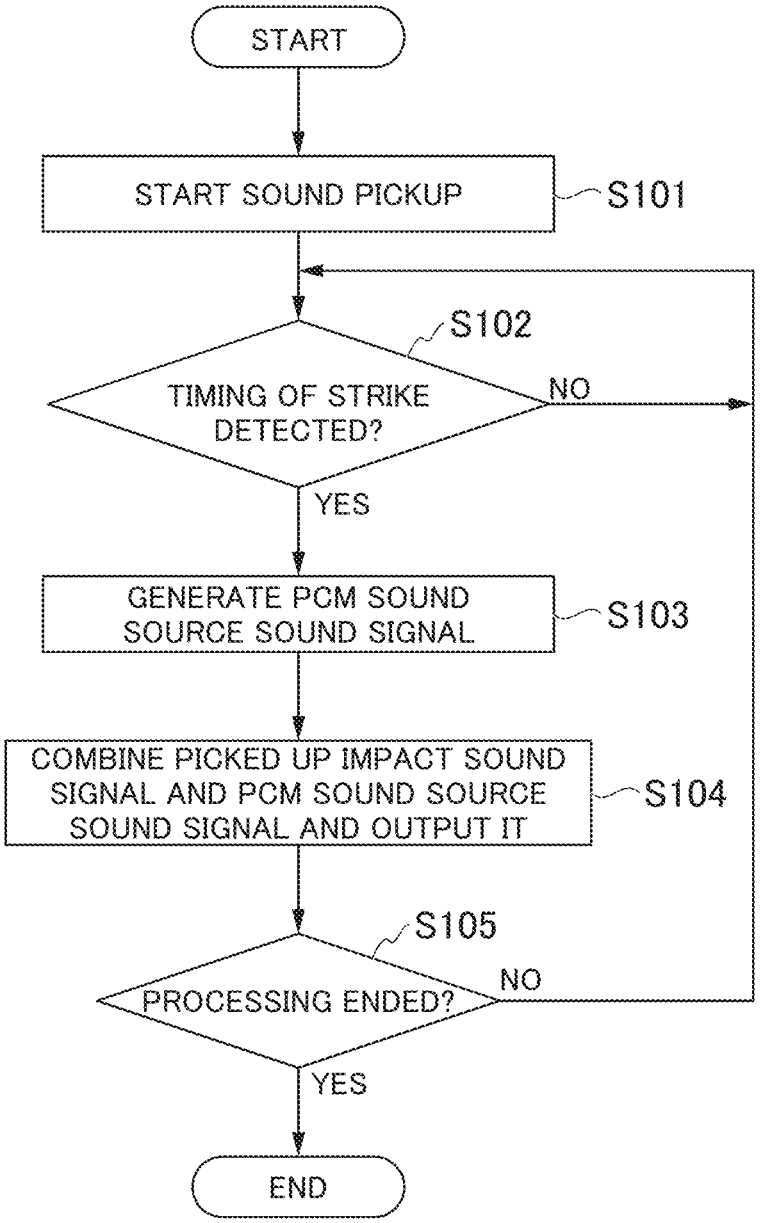
FIG. 4 is a flowchart showing an example of the operation of the sound processing device according to the first embodiment.

FIG. 4 is a flowchart showing an example of the operation of the sound processing device 1 according to the present embodiment.

When the operation is started by the operation to the operation unit 13, the sound processing device 1 first starts picking up sound (Step S101), as shown in FIG. 4. That is, the sound pickup unit 12 starts picking up the ambient sound.

Next, the combining processing unit 30 of the sound processing apparatus 1 determines whether or not the timing of a strike has been detected (Step S102). When the user plays a cymbal, the sensor unit 11 outputs the detection signal S1 showing the detection of the timing of the strike, and the combining processing unit 30 detects the timing of the strike on the basis of the detection signal S1. When the strike timing is detected (Step S102: YES), the combining processing unit 30 advances the processing to Step S103. When the strike timing is not detected (Step S102: NO), the combining processing unit 30 returns the processing to Step S102.

In Step S103, the sound source signal generating unit 31 of the combining processing unit 30 generates a PCM sound source sound signal. The sound source signal generating unit 31 generates the PCM sound source sound signal S3 on the basis of the PCM sound source data stored in the storage unit 14 (refer to the waveform W2 in FIG. 3).

Next, the combining unit 32 of the combining processing unit 30 combines the picked up impact sound signal S2 and the PCM sound source sound signal S3 and outputs the combined signal S4 (Step S104). That is, the combining unit 32 combines the impact sound signal S2 and the PCM sound source sound signal S3 to generate a combined signal S4, and causes the output unit 15 to output the combined signal S4 that has been generated (refer to the waveform W4 in FIG. 3).

Next, the combining processing unit 30 determines whether or not the processing has ended (Step S105). The combining processing unit 30 determines whether or not the processing has ended depending on whether or not the operation has been stopped by an operation inputted via the operation unit 13. When the processing is ended (Step S105: YES), the combining processing unit 30 ends the processing. If the processing is not ended (Step S105: NO), the combining processing unit 30 returns the processing to Step S102 and waits for the timing of the next strike.

As described above, the sound processing device 1 according to the present embodiment includes a sound pickup unit 12, a sensor unit 11, and a combining processing unit 30. The sound pickup unit 12 picks up an impact sound of the cymbal 2 (percussion instrument) of a drum set. The sensor unit 11 detects time information (for example, timing) of the strike when the cymbal 2 is played. Based on the time information of the strike detected by the sensor unit 11, the combining processing unit 30 combines the impact sound picked up by the sound pickup unit 12 with a sound source sound (for example, a PCM sound source sound).

Thereby, the sound processing device 1 according to the present embodiment can approximate the sound of a cymbal such as one in an ordinary acoustic drum set by combining the picked-up impact sound and the PCM sound source sound. That is, the sound processing device 1 according to the present embodiment can reproduce the expressive power of an ordinary acoustic drum set while reducing the possibility of an unnatural impact sound. Therefore, the sound processing device 1 according to the present embodiment can improve the expressive power of an impact sound by a percussion instrument.

In addition, since the sound processing device 1 according to the present embodiment can be realized merely by combining (for example, adding) a picked-up impact sound and a PCM sound source sound, it is possible to improve expressive power without requiring complicated processing. Moreover, since the sound processing device 1 according to the present embodiment does not require complicated processing, the sound processing can be realized by real-time processing.

Further, in the present embodiment, the combining processing unit 30 combines the attack portion TR1 obtained from the impact sound picked up by the sound pickup unit 12, with the body portion TR2 obtained from the PCM sound source sound. The attack portion TR1 corresponds to a predetermined period immediately after the strike. The body portion TR2 corresponds to a period after the attack portion TR1.

Thereby, in the sound processing device 1 according to the present embodiment, for example, when the signal level of the body portion TR2 is weak such as for the cymbal 2 having a silencing function, the body portion TR2 can be strengthened by the PCM sound source sound. Therefore, in a percussion instrument such as the cymbal 2 having a silencing function, the sound processing device 1 according to the present embodiment can make the body portion TR2 approximate a natural sound.

Also, in the present embodiment, the PCM sound source sound is generated so as to supplement a component lacking in the impact sound of the cymbal 2 with respect to a target impact sound (see the waveform W1 in FIG. 2) indicating an impact sound that is targeted. Here, the component lacking in the impact sound of the percussion instrument includes at least one component among a frequency component and a time change component.

Thereby, in the sound processing device 1 according to the present embodiment, the PCM sound source sound is generated so as to supplement the component lacking in the impact sound of the cymbal 2 with respect to the target impact sound. Therefore, the combining processing unit 30, by combining the PCM sound source sound with the impact sound, enables generation of sound which is approximate to the target impact sound (the sound of an ordinary acoustic drum).

In addition, the sound processing method according to the present embodiment includes a sound pick-up step, a detection step, and a combining processing step. In the sound pick-up step, the sound pickup unit 12 picks up the impact sound of the cymbal 2. In the detection step, the sensor unit 11 detects time information of the strike when the cymbal 2 is played. In the combining processing step, the combining processing unit 30 combines the impact sound picked up by the sound pick-up step and the sound source sound on the basis of time information of the strike detected by the detection step.

Thereby, the sound processing method according to the present embodiment exhibits the same advantageous effect as that of the above-described sound processing device 1, and can improve the expressive power of an impact sound from a percussion instrument.

Second Embodiment

In the first embodiment described above, an example has been described of combining the impact sound signal S2 and the PCM sound source sound signal S3 by simple addition or switching therebetween. On the other hand, in the second embodiment, a modification is described in which the impact sound signal S2 and the PCM sound source sound signal S3 are combined after performing processing on either one thereof.

The configuration of the sound processing device 1 according to the second embodiment is the same as that of the first embodiment except for the processing by the combining processing unit 30. The processing performed by the combining processing unit 30 is described below.

In the combining processing unit 30 according to the present embodiment, the combining processing unit 30 or the combining unit 32 adjusts a sound source sound according to the signal level of the impact sound picked up by the sound pickup unit 12. For example, in accordance with the maximum value of the signal level of the impact sound signal S2 or the signal level of the impact sound signal S2 at a predetermined position, the sound source signal generating unit 31 adjusts at least one of the signal level, the attenuation rate, and the envelope of the PCM sound source sound signal S3 and outputs the adjusted PCM sound source sound signal S3. The combining unit 32 combines the impact sound signal S2 and the adjusted PCM sound source sound signal S3 to generate the combined signal S4, and outputs the combined signal S4 which approximates to a natural impact sound, via the output unit 15. The signal level of the impact sound here is an example of operation information.

Figure 5:
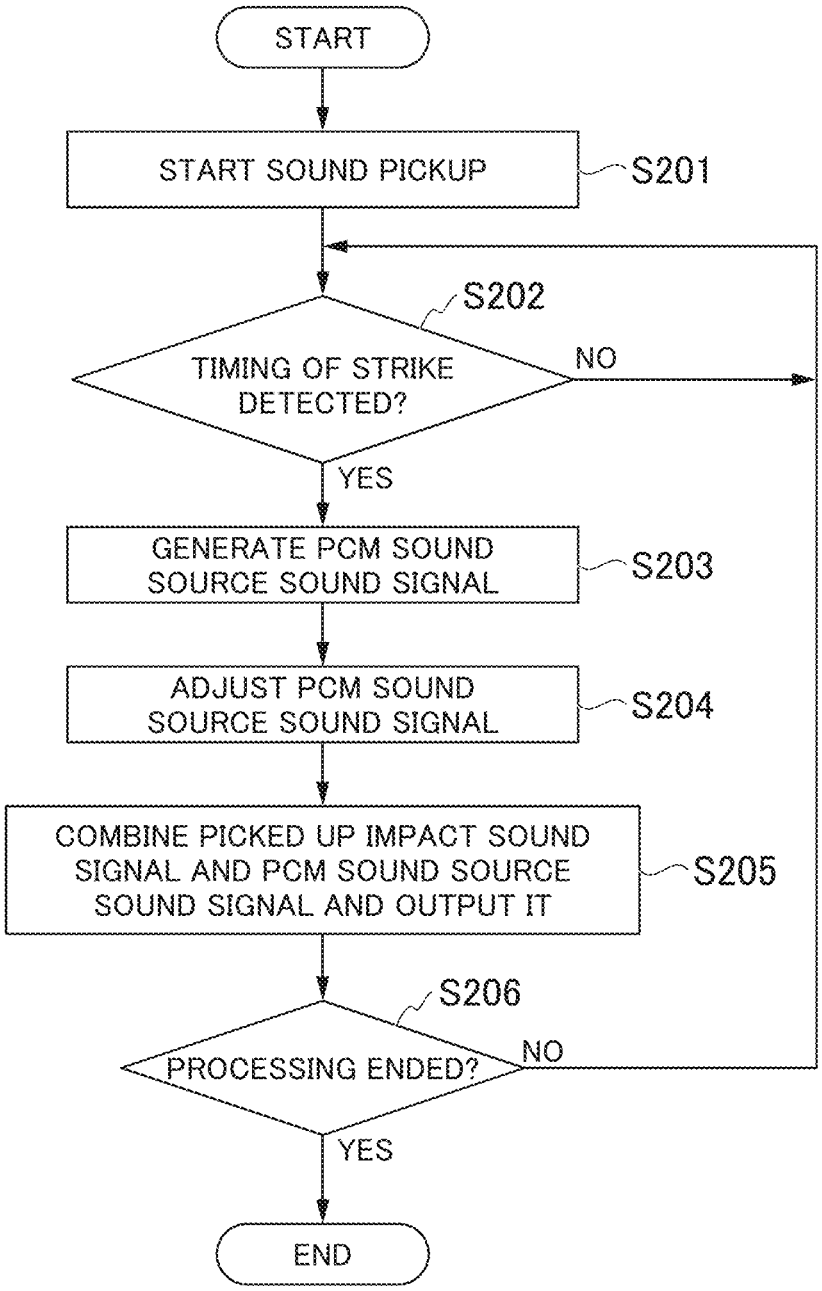
FIG. 5 is a flowchart showing an example of the operation of a sound processing device according to a second embodiment.

FIG. 5 is a flowchart showing an example of the operation of the sound processing device 1 according to the present embodiment.

In FIG. 5, since the processing from Step S201 to Step S203 is the same as the processing from Step S101 to Step S103 in FIG. 4 described above, descriptions thereof will be omitted here.

In Step S204, the sound source signal generating unit 31 or the combining unit 32 adjusts the PCM sound source sound signal S3 (Step S204). For example, the sound source signal generating unit 31 adjusts at least one of the signal level, the attenuation rate, and the envelope of the PCM sound source sound signal S3 in accordance with the signal level of the impact sound signal S2 and outputs the adjusted PCM sound source sound signal S3. Note that the combining unit 32 may execute the process of Step S204.

Since the subsequent processing in Step S205 and Step S206 is similar to the processing in Step S104 and Step S105 in FIG. 4 described above, descriptions thereof are omitted here.

In the example described above, the PCM sound source sound is adjusted according to the signal level of the impact sound picked up by the sound pickup unit 12. Here, the combining processing unit 30 may also perform adjustment so that the boundary between the attack portion TR1 and the body portion TR2 does not become unnatural.

For example, the combining processing unit 30 may combine the picked-up impact sound and the PCM sound source sound so that the volume of the sounds at the boundary between the attack portion TR1 and the body portion TR2 match. In this case, the combining processing unit 30 or the combining unit 32 for example adjusts the PCM sound source sound signal S3 of the body portion TR2 in accordance with the impact sound signal S1 of the attack portion TR1 that was picked up so that the volume of the sounds at the boundary coincide. The volume of the sound is, for example, the sound pressure level, loudness, acoustic energy (sound intensity), signal-noise (SN) ratio, and the like, and is the sound volume that a human feels.

As described above, the boundary between the attack portion TR1 and the body portion TR2 may be a position (point in time) corresponding to the passage of a predetermined period of time from the detection signal S1 of the timing of the strike. The boundary may be a position (corresponding to the point in time) at which the pitch of the detection signal S1 which has a passed through a low-pass filter is stable (the frequency components of the detection signal S1 which are more than a predetermined value are eliminated by the low-pass filter). Further, the position (corresponding to the point in time) at which a predetermined period has elapsed may be determined by an elapsed period of time from a strike timing set by the operation unit 13.

Further, the combining processing unit 30 may combine the picked-up impact sound and the PCM sound source sound by crossfading them so as not to produce a discontinuous sound at the boundary of the attack portion TR1 and the body portion TR2. In this case, for example, the combining processing unit 30 performs adjustment that attenuates the acoustic energy of the picked up impact sound, which is the attack portion TR1, at a faster rate than the natural attenuation, and increases the acoustic energy of the PCM sound source, which is the body portion TR2, so that the combined signal S4 matches the natural attenuation. By doing so, the combining processing unit 30 can combine the picked-up impact sound and the PCM sound source sound so that the signal waveform in the time domain does not become discontinuous.

Alternatively, for example, the combining processing unit 30 may combine the sounds such that the pitch of the picked-up impact sound matches the pitch of the PCM sound source sound. In this case, the combining processing unit 30 or the combining unit 32 adjusts the PCM sound source sound signal S3 of the body part TR2 in accordance with the impact sound signal S2 of the attack portion TR1 that was picked up so that the pitch at the boundary coincide with each other. The pitch at the boundary may be the height of the sound of a specific frequency such as the integer overtone of the dominant pitch or the characteristic pitch. Here, with reference to FIG. 6 and FIG. 7, details of the process of matching the pitch at the boundary will be described.

Figure 6:
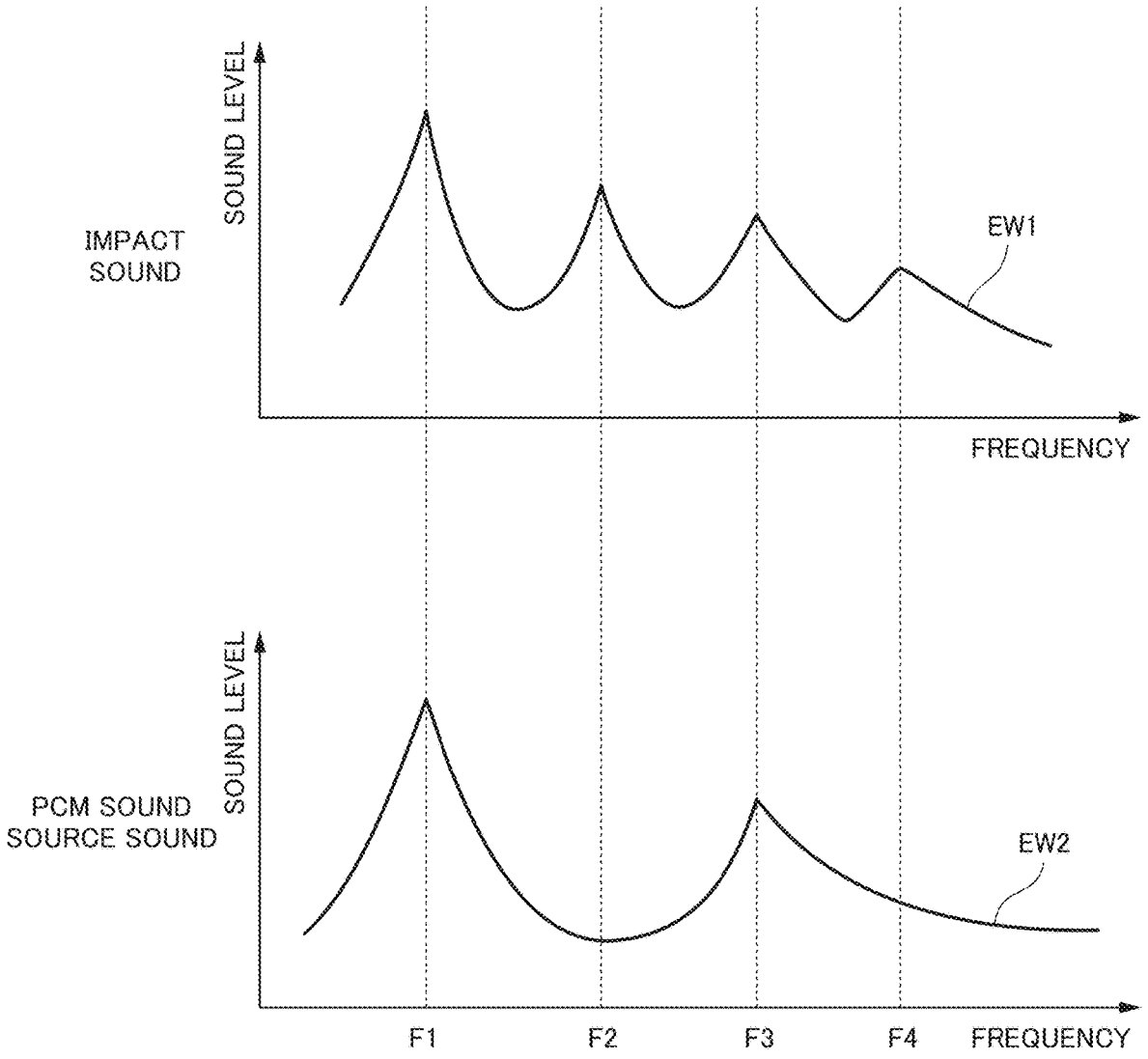
FIG. 6 is a first diagram for describing an example of combining that matches a specific frequency.
Figure 7:
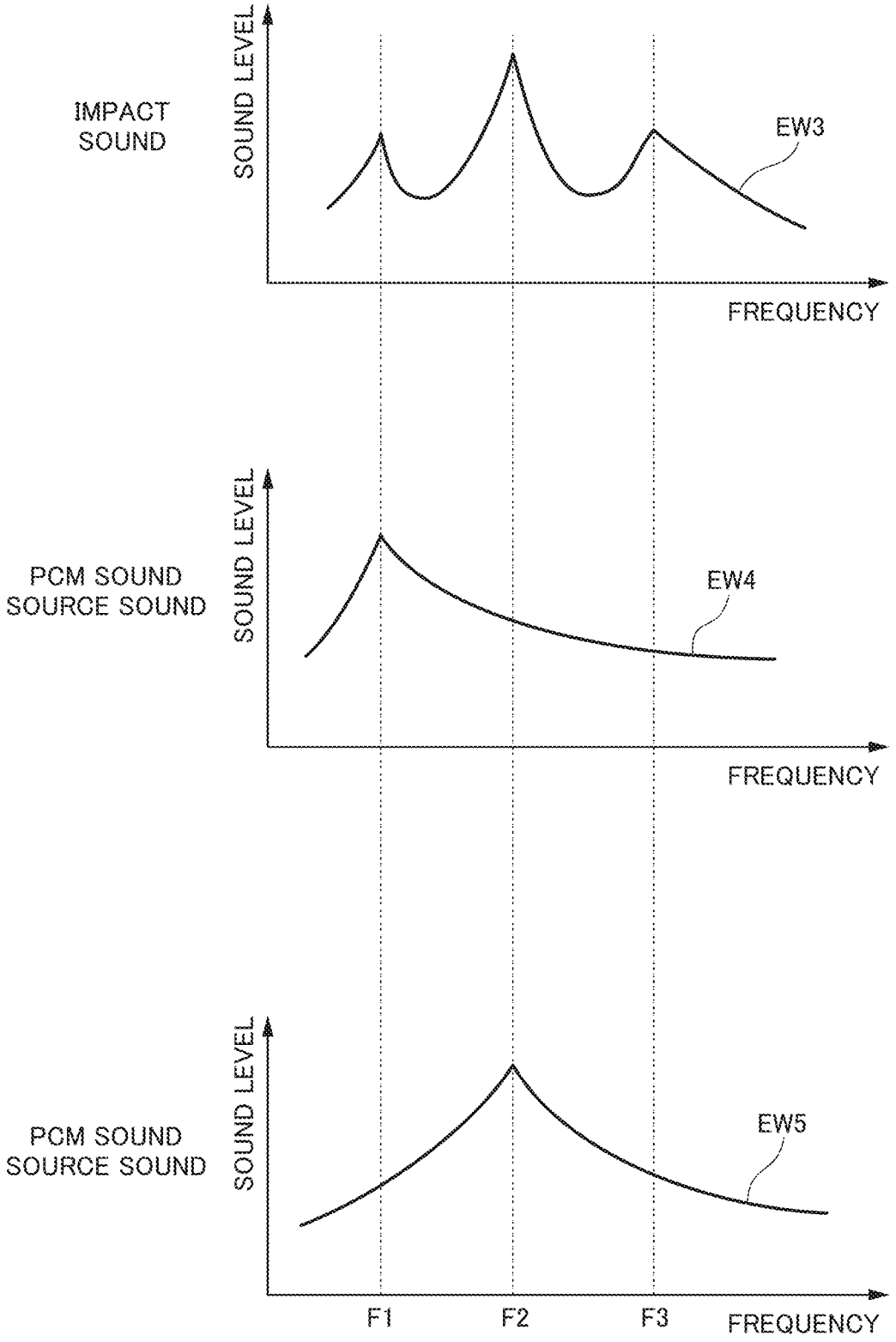
FIG. 7 is a second diagram for describing an example of combining that matches a specific frequency.

FIG. 6 and FIG. 7 are graphs for describing an example of sound combination in which a specific frequency is matched.

In FIG. 6, the horizontal axis of each graph shows frequency and the vertical axis shows sound level. In addition, an envelope waveform EW1 indicates the envelope waveform in the frequency domain of the picked-up impact sound. In addition, the envelope waveform EW2 indicates the envelope waveform in the frequency domain of the PCM sound source sound.

The frequency F1 is a characteristic frequency of the lowest frequency region of the picked-up impact sound, with the frequency F2, the frequency F3, and the frequency F4 being characteristic frequencies of higher regions. Note that the frequencies F2, F3, and F4 are frequencies of integer overtones of the frequency F1. Here, a characteristic frequency is a frequency indicating a characteristic convex vertex in the envelope in the sound frequency domain, and is an example of operation information (strike information).

As shown in the envelope waveform EW2, the combining processing unit 30 adjusts the PCM sound source sound such that at least one of these characteristic frequencies of each of the picked-up impact sound and the PCM sound source sound coincide. In the example shown in FIG. 6, the combining processing unit 30 adjusts the PCM sound source sound so that characteristic frequencies (F1, F3) of the envelope waveform EW1 and two characteristic frequencies of the envelope waveform EW2 match. In this way, the combining processing unit 30 combines the picked-up impact sound and the PCM sound source sound so that characteristic frequencies of each coincide with each other.

In FIG. 7, as in the example shown in FIG. 6, the horizontal axis of each graph shows frequency and the vertical axis shows sound level. An envelope waveform EW3 indicates the envelope waveform in the frequency domain of the picked-up impact sound. In addition, the envelope waveform EW4 and the envelope waveform EW5 each indicate an envelope waveform in the frequency domain of a PCM sound source sound. In this figure, the characteristic frequencies of the picked-up impact sound are frequency F1, frequency F2, and frequency F3.

As shown in the envelope waveform EW4, the combining processing unit 30 may adjust the PCM sound source sound so that the characteristic frequency F1 of the picked-up impact sound and the characteristic frequency of the PCM sound source sound match. Further, as shown in the envelope waveform EW5, the combining processing unit 30 may adjust the PCM sound source sound so that the characteristic frequency F2 of the picked-up impact sound and the characteristic frequency of the PCM sound source sound match.

The combining processing unit 30 may adjust the frequency of the PCM sound source sound in accordance with the signal level of the impact sound. In this case, the combining processing unit 30 may adjust the frequency of the PCM sound source sound on the basis of an adjustment table. The adjustment table may be set up in advance and may, for example, store the characteristic frequencies in association with the signal level of the impact sound.

As described above, in the sound processing device 1 according to the present embodiment, the combining processing unit 30 adjusts the PCM sound source sound according to the signal level of the picked-up impact sound.

Thereby, the sound processing device 1 according to the present embodiment can output a more natural impact sound and can improve the expressive power of an impact sound made by the cymbal 2 (percussion instrument).

Third Embodiment

In the first and second embodiments described above, examples have been described of improving the expressive power of the impact sound of the cymbal 2 in a drum set as an example of a percussion instrument. In the third embodiment, a modification will be described corresponding to a snare drum 2*a* as shown in FIG. 8 instead of the cymbal 2.

Figure 8:
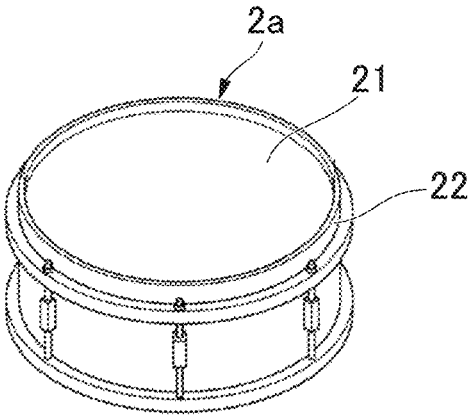
FIG. 8 is a diagram that shows an example of a drum according to a third embodiment.

FIG. 8 is a view showing an example of a drum according to the third embodiment. In FIG. 8, the snare drum 2*a* is a drum having a silencing function, and includes a drum head 21 and a rim 22 (hoop). Unlike the above-described cymbal 2, in the impact sound when the drum head 21 is played, the signal level of the sound signal of the attack portion TR1 tends to be smaller than the impact sound of an ordinary acoustic drum (ordinary snare drum).

For that reason, the combining processing unit 30 of the present embodiment performs combination using a PCM sound source sound for the attack portion TR1 and using an impact sound picked up by the sound pickup unit 12 for the body portion TR2.

The configuration of the sound processing device 1 according to the third embodiment is the same as that of the first embodiment except for the processing of the combining processing unit 30. Hereinafter, the operation of the sound processing device 1 according to the third embodiment will be described with a focus on the processing of the combining processing unit 30.

The combining processing unit 30 in the present embodiment combines the attack portion TR1 obtained from the PCM sound source sound and the body portion TR2 obtained from the impact sound picked up by the sound pickup unit 12.

Here, the operation of the sound processing device 1 according to the present embodiment will be described with reference to FIG. 9.

Figure 9:
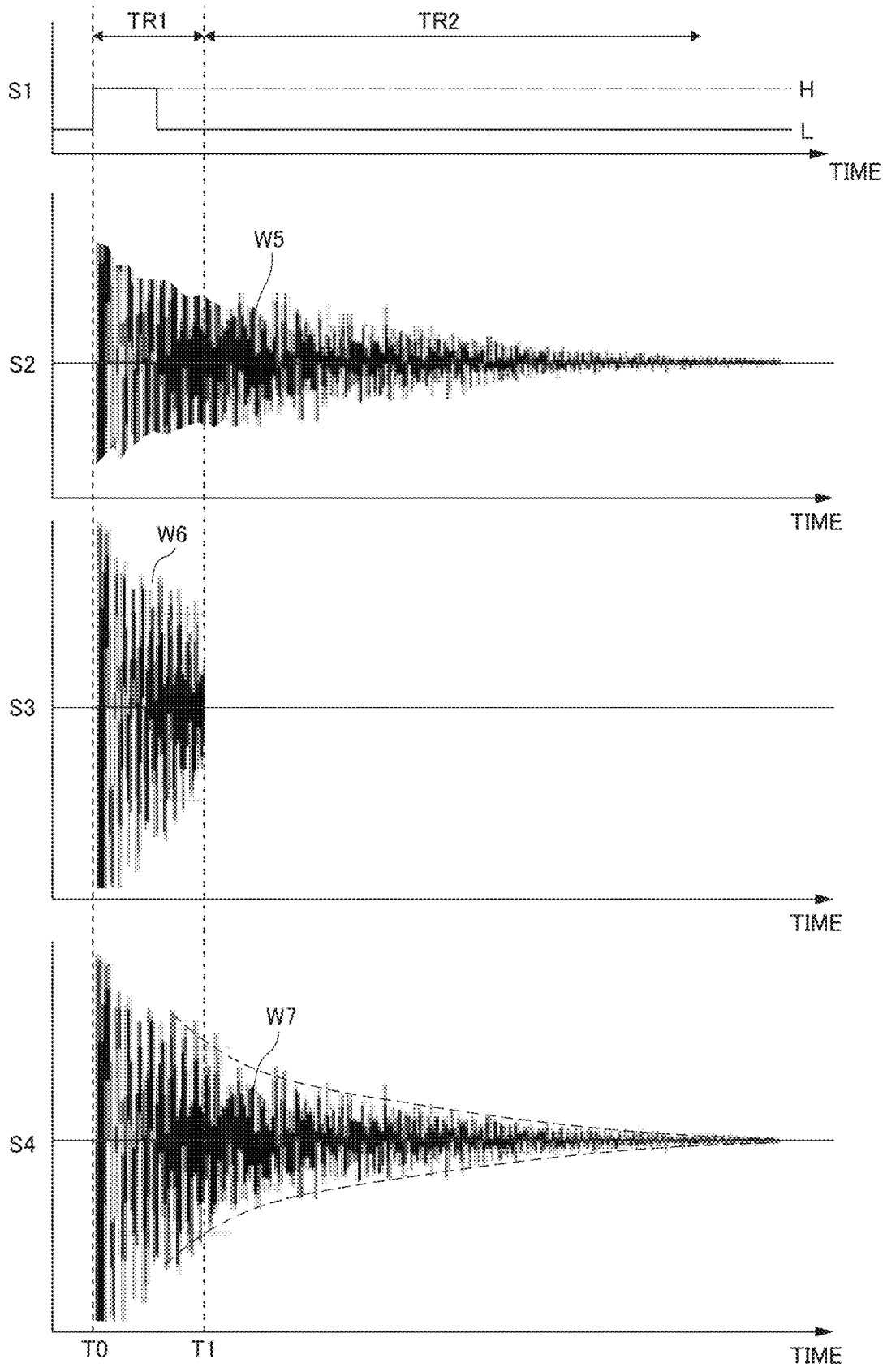
FIG. 9 is a flowchart that shows an example of the operation of the sound processing device according to a third embodiment.

FIG. 9 is a diagram showing an example of the operation of the sound processing device 1 according to the present embodiment.

The signal shown in FIG. 9 includes, in order from the top, the detection signal S1 of the sensor unit 11, the impact sound signal S2 picked up by the sound pickup unit 12, the PCM sound source sound signal S3 generated by the sound source signal generating unit 31, and the combined signal S4 generated by the combining unit 32. Also, the horizontal axis of each signal shows time, while the vertical axis shows the logic state for the detection signal S1, and the signal level (voltage) for the other signals.

As shown in FIG. 9, when the user hits the drum head 21 of the snare drum 2*a* at time T0, the sensor unit 11 puts the detection signal S1 in the H state. The sound pickup unit 12 picks up the impact sound of the drum head 21 and outputs the impact sound signal S2 as shown in a waveform W5.

In addition, the sound source signal generating unit 31 generates the PCM sound source sound signal S3 of the attack portion TR1 as shown in a waveform W6 on the basis of the PCM sound source data stored in the storage unit 14, with the transition of the detection signal S1 to the H state serving as a trigger.

In addition, the combining unit 32 combines the PCM sound source sound signal S3 of the attack portion TR1 and the impact sound signal S2 of the body portion TR2, to generate the combined signal S4 as shown in a waveform W7, with the transition of the detection signal S1 to the H state serving as a trigger. Note in combining the waveform W6 and the waveform W5, the combining unit 32 determines, for example, a predetermined period directly after the strike (the period from time T0 to time T1) as the attack portion TR1 and determines a period from time T1 onward as the body portion TR2.

The combining unit 32 outputs the combined signal S4 of the generated waveform W7 to the output unit 15. Then, the output unit 15 causes the external device 50 (for example, a sound emitting device such as headphones) to emit the combined signal of the waveform W7 via a cable or the like.

As described above, in the sound processing device 1 according to the present embodiment, the combining processing unit 30 combines the attack portion TR1 obtained from the PCM sound source sound and the body portion TR2 obtained from the impact sound picked up by the sound pickup unit 12.

Thereby, in the sound processing device 1 according to the present embodiment, for example, when the signal level of the attack portion TR1 is weak such as for the snare drum 2*a* having a silencing function, the attack portion TR1 can be strengthened by the PCM sound source sound. Therefore, in a percussion instrument such as the snare drum 2*a* having a silencing function, the sound processing device 1 according to the present embodiment can make the sound of the body portion TR2 approximate a natural sound. Therefore, the sound processing device 1 according to the third embodiment can improve the expressive power of an impact sound produced by a percussion instrument, as in the first and second embodiments described above.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

For example, in each of the above embodiments, the example has been described in which the combining processing unit 30 adjusts, for example, the signal level, the attenuation factor, the envelope, the pitch, the amplitude, the phase, and the like of the PCM sound source sound signal S3 for combination with the impact sound signal S2, but is not limited thereto. For example, the combining processing unit 30 may adjust and process the frequency component of the PCM sound source sound signal S3. That is, the combining processing unit 30 may process not only the time signal waveform but also the frequency component waveform.

Further, when combining the impact sound signal S2 and the PCM sound source sound signal S3, the combining processing unit 30 may add sound effects such as reverberation, delay, distortion, compression, or the like.

As a result, the sound processing device 1 can add to an impact sound, for example, a sound from which a specific frequency component is removed, a sound to which a reverberation component is added, an effect sound, or the like. Therefore, the sound processing device 1 is capable of further improving the expressive power of the performance sound by the musical instrument.

Further, in the third embodiment, an example has been described corresponding to the impact sound of the drum head 21 of the snare drum 2*a*. Alternatively, one embodiment may be adapted to correspond to a rimshot when the rim 22 is struck. In the case of a rimshot, the combining processing unit 30 uses the PCM sound source sound signal S3 for the body portion TR2, similarly to the above-described cymbal 2. In addition, the sound processing device 1, by determining whether or not the impact sound is from the drum head 21 or the rim 22 depending on the detection by the sensor unit 11 or the shape of the impact sound signal S2, may output the combined signal S4 corresponding to the determination.

That is, depending on the type of impact sound, the combining processing unit 30 may change the combination of the picked-up impact sound and the PCM sound source sound and combine the sounds (with the different combination). Specifically, when the impact sound is an impact sound of the drum head 21, the combining processing unit 30 combines the PCM sound source sound signal S3 of the attack portion TR1 and the impact sound signal S2 of the body portion TR2. When the impact sound is an impact sound of the rim 22 (rimshot), the combining processing unit 30 combines the impact sound signal S2 of the attack portion TR1 and the PCM sound source sound signal S3 of the body portion TR2. That is, the combining processing unit 30 may be used to switch between the case of combining a combination of the PCM sound source sound of the attack portion TR1 and the impact sound of the body portion TR2, and the combination of the impact sound of the attack portion TR1 and the PCM sound source sound of the body portion TR2. Thereby, the sound processing device 1 can further improve the expressive power of impact sounds.

In each of the above embodiments, an example has been described of using the sound processing device 1 in a drum set having a silencing function as one example of a percussion instrument. However, the embodiments are not limited thereto. For example, the sound processing device may be applied to other percussion instruments such as other types of drums including Japanese taiko drums.

In each of the above-described embodiments, the example has been described in which the sound source signal generating unit 31 generates a sound signal with a PCM sound source, but a sound signal may be generated from another sound source.

In each of the above-described embodiments, an example has been described in which the combining processing unit 30 detects the signal level of the impact sound from the signal level of the impact sound picked up by the sound pickup unit 12, but the embodiments are not limited thereto. For example, the signal level of the impact sound also may be detected on the basis of a detection value in the vibration sensor of the sensor unit 11.

In each of the above embodiments, an example has been described in which the output unit 15 is an output terminal. However, an amplifier may be provided so that the combined signal S4 can be amplified.

Furthermore, in each of the above-described embodiments, an example has been described in which the combining processing unit 30 processes the impact sound of a percussion instrument in real time and outputs the combined signal S4, but the embodiments are not limited thereto. The combining processing unit 30 may generate the combined signal S4 on the basis of a recorded detection signal S1 and impact sound signal S2. That is, the combining processing unit 30 may, on the basis of the timing of a recorded strike, combine an impact sound picked up by the pickup unit and recorded and the PCM sound source sound.

Further, in each of the above-described embodiments, an example was described in which the sound processing device 1 is applied to a percussion instrument, such as a drum, as an example of a musical instrument, but the present invention is not limited thereto. The sound processing device 1 may be applied to other musical instruments such as string instruments and wind instruments. In this case, the sound pickup unit 12 picks up performance sounds generated from the musical instrument by a performance operation instead of impact sounds, and the sensor unit 11 detects the presence of the performance operation on the musical instrument instead of the presence of a strike.

In addition, in FIG. 1 described above, a determining unit for determining a musical instrument sound may be provided between the sensor unit 11 and the combining processing unit 30. In this case, for example, the determining unit may determine the type of the musical instrument by machine learning, or determine the frequency of the detection signal S1 by frequency analysis, and then select the PCM sound source sound according to the result of the frequency determination.

The above-described sound processing device 1 has a computer system therein. Each processing step of the above-described sound processing device 1 is stored in a computer-readable recording medium in the form of a program, and the above processing is performed by the computer reading and executing this program. Here, the computer-readable recording medium means a magnetic disk, a magneto-optical disk, a CD-ROM, a DVD-ROM, a semiconductor memory, or the like. Further, the computer program may be distributed to a computer through communication lines, and the computer that has received this distribution may execute the program.

What is claimed is:

1. A sound processing device comprising:

a combining processor that generates a combined sound by combining a performance sound and a source sound, based on operation information corresponding to a performance operation on an instrument, the performance sound being obtained by picking up a sound generated by the performance operation on the instrument, and the source sound being obtained from a sound source, wherein the combined sound comprises:

a sound in a first period comprising one of the performance sound or the source sound; and a sound in a second period, which is continuous with the first period, comprising the other of the performance sound or the source sound, and wherein the first period is a predetermined period or is a period whose end is determined based on a position at which a pitch of the performance sound is stable.

2. The sound processing device according to claim 1, wherein:

the sound generated by the performance operation on the instrument comprises an impact sound generated by striking a percussion instrument, the operation information comprises time information that indicates a point in time at which the impact sound is generated, the performance sound is obtained by picking up the impact sound, and the combining processor combines the impact sound and the source sound, based on the time information.

3. The sound processing device according to claim 1, wherein:

the operation information comprises a signal level of the performance sound, and the combining processor adjusts the source sound in accordance with the signal level of the performance sound.

4. The sound processing device according to claim 1, wherein:

the operation information comprises a characteristic frequency of the performance sound, the characteristic frequency of the performance sound corresponding to a convex vertex in an envelope of the performance sound in a frequency domain, the source sound comprises a characteristic frequency corresponding to a convex vertex in an envelope of the source sound in a frequency domain, and the combining processor makes the characteristic frequency of the source sound coincide with the characteristic frequency of the performance sound.

5. The sound processing device according to claim 1, wherein:

the sound in the first period comprises the performance sound, the sound in the second period comprises the source sound, the performance operation on the instrument comprises a strike on a percussion instrument, and the first period starts immediately after the strike on the percussion instrument.

6. The sound processing device according to claim 1, wherein the sound in the second period is free from the performance sound.

7. The sound processing device according to claim 1, wherein:

the sound in the first period comprises the source sound, the sound in the second period comprises the performance sound, the performance operation on the instrument comprises a strike on a percussion instrument, and the first period starts immediately after the strike on the percussion instrument.

8. The sound processing device according to claim 1, wherein the sound in the second period is free from the source sound.

9. The sound processing device according to claim 1, wherein:

the combining processor makes a volume of the combined sound at an end of the first period and a volume of the combined sound at a start of the second period coincide with each other.

10. The sound processing device according to claim 1, wherein:

the combining processor combines the performance sound and the source sound by crossfading the performance sound and the source sound.

11. The sound processing device according to claim 1, wherein the source sound comprises a component lacking in the performance sound of the instrument in comparison with a performance sound that is targeted.

12. The sound processing device according to claim 1, further comprising:

a sound pickup unit that picks up the sound generated by the performance operation on the instrument.

13. The sound processing device according to claim 1, further comprising:

a sensor unit that detects the performance operation on the instrument.

14. The sound processing device according to claim 1, wherein the performance operation is obtained according to presence of the performance operation on the instrument.

15. The sound processing device according to claim 1, wherein the first period is the predetermined period.

16. The sound processing device according to claim 1, wherein the first period is the period whose end is determined based on the position at which the pitch of the performance sound is stable.

17. The sound processing device according to claim 16, wherein the pitch of the performance sound is a pitch of the performance sound that has passed through a low-pass filter.

18. A sound processing device comprising:

a combining processor that combines a performance sound and a source sound, based on operation information corresponding to a performance operation on an instrument, the performance sound being obtained by picking up a sound generated by the performance operation on the instrument, and the source sound being obtained from a sound source, wherein the first period is a predetermined period or is a period whose end is determined based on a position at which a pitch of the performance sound is stable, and wherein the source sound comprises a frequency component lacking in the performance sound of the instrument in comparison to a targeted performance sound.

19. A sound processing method comprising:

generating a combined sound by combining a performance sound and a source sound, based on operation information corresponding to a performance operation on an instrument, the performance sound being obtained by picking up a sound generated by the performance operation on the instrument, and the source sound being obtained from a sound source, wherein the combined sound comprises:

a sound in a first period comprising one of the performance sound or the source sound; and a sound in a second period, which is continuous with the first period, comprising the other of the performance sound or the source sound, and wherein the first period is a predetermined period or is a period whose end is determined based on a position at which a pitch of the performance sound is stable.

* * * * *